US006631981B2

(12) United States Patent
Isono et al.

(10) Patent No.: US 6,631,981 B2
(45) Date of Patent: Oct. 14, 2003

(54) PIEZOELECTRIC ACTUATOR OF INK JET PRINTER HEAD

(75) Inventors: Jun Isono, Nagoya (JP); Atsuhiro Takagi, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/897,394

(22) Filed: Jul. 3, 2001

(65) Prior Publication Data

US 2002/0003560 A1 Jan. 10, 2002

(30) Foreign Application Priority Data

Jul. 6, 2000 (JP) ..... 2000-204730
Jul. 24, 2000 (JP) ..... 2000-222568

(51) Int. Cl.[7] ..... B41J 2/045
(52) U.S. Cl. ..... 347/72
(58) Field of Search ..... 347/68, 69, 70, 347/71, 72

(56) References Cited

U.S. PATENT DOCUMENTS 4,805,057 A * 2/1989 Ogawa et al. ..... 360/109
5,402,159 A 3/1995 Takahashi et al. ..... 347/9

FOREIGN PATENT DOCUMENTS

JP 7-96301 B2 10/1995
JP 09150517 A * 6/1997 ..... B41J/2/06
JP 09162450 A * 6/1997 ..... H01L/41/083
JP 11233847 A * 8/1999 ..... H01L/41/22

* cited by examiner

*Primary Examiner*—Anh T. N. Vo
(74) *Attorney, Agent, or Firm*—Oliff & Berridge, PLC

(57) ABSTRACT

Odd-numbered piezoelectric sheets 22, 21*b*, 21*d*, and 21*f* are formed with a plurality of individual electrodes 24. Even-numbered piezoelectric sheets 21*a*, 21*c*, 21*e*, and 21*g* are formed with a common electrode 25. These odd-numbered and even-numbered piezoelectric sheets are alternatively arranged one on the other to form a laminated body. A top sheet 23 is mounted on the laminated body. Surface electrodes 30, 31 are formed on the top sheet 23. Through holes 32, 33 are opened to the piezoelectric sheets 21*a* through 21*g* for providing electrical connection of the individual electrodes 24 and the common electrodes 25, but not to the piezoelectric sheet 22 that is laminated on a cavity plate 10.

12 Claims, 12 Drawing Sheets

PIEZOELECTRIC ACTUATOR OF INK JET PRINTER HEAD

BACKGROUND OF THE INVENTION

1. Field of the Invention

The present invention relates to a piezoelectric actuator in the form of a plate used in a piezoelectric ink jet printer head, and more specifically to configuration of common electrodes and individual electrodes of such a piezoelectric actuator.

2. Description of Related Art

FIG. 1 shows a conventional piezoelectric ink jet printer head 100 disclosed in U.S. Pat. No. 5,402,159. As shown in FIG. 1, the conventional head 100 includes a nozzle plate 117, a cavity plate 115, a piezoelectric actuator 111 in the form of a plate, and a back plate 119. The nozzle plate 117 is formed with a plurality of nozzles 118. The cavity plate 115 is formed with a plurality of ink cavities 116, each corresponding to one of the plurality of nozzles 118.

The piezoelectric actuator 111 includes a plurality of piezoelectric ceramic layers 110 called green sheets. Individual electrodes 112 are formed on each of a half of the piezoelectric ceramic layers 110, and a common electrode 113 is formed on each of another half of the piezoelectric ceramic layers 110. These two types of layers are alternatively arranged one on the other to have a laminated structure. Each of the individual electrodes 112 corresponds to one of the ink cavities 116. The common electrodes 113 are common to all the ink cavities 116.

The piezoelectric actuator 111 also includes outer electrodes 114 formed on its side surface by vacuum metallizing, metal spattering, conductive paste coating, or the like. Each outer electrode 114 electrically connects one of the sets of the individual electrodes 112 to the outside.

However, in this configuration, when the end portion of each individual electrode 112 may not reach the side surface of the piezoelectric actuator 111, the electrical connection between the individual electrode 112 and the outer electrode 114 would be insufficient. Also, during the conductive paste coating and the like for forming the outer electrode 114, the orientation of the piezoelectric actuator 111 is changed such that its side surface faces upward. This complicates the production process.

Moreover, there is a danger that the electrical connection of the electrodes 112 and 114 is damaged by accidentally contacting a handler or a tool during the production or assembly of the piezoelectric actuator 111.

In order to overcome these problems, as shown in FIGS. 2 through 4, Japanese Patent Publication No. HEI-7-96301 has proposed to form a lead-out electrode 8*a*, 9*a* to each of the individual and common electrodes 8, 9. A plurality of first through-holes 2 are formed to penetrate through piezoelectric ceramic sheets 6 and the lead-out electrodes 8*a* of the corresponding individual electrodes 8. Also, a second through hole 3 is formed to penetrate through piezoelectric ceramic sheets 6 and the lead-out electrodes 9*a* of the common electrodes 9. Then, each of the first and second through holes 2, 3 are filled with conductive paste, so that the individual electrodes 8 and the common electrodes 9 are electrically connected to an external electrode through the through holes 2 and 3.

In this case, the through holes 2, 3 are formed to all the piezoelectric ceramic sheets 6, but not to a cavity plate 4, which is formed with ink cavities 4*a* and an ink channel 4*b*.

However, because the cavity plate 4 is formed from a piezoelectric ceramic sheet also, when the through holes 2, 3 are formed connected to the ink cavities 4*a* or the ink channel 4*b*, short circuits will result. Therefore, in order to avoid the short circuit, positions of the through holes 2, 3 need to be carefully selected, and so the configuration of a piezoelectric actuator is strictly restricted.

SUMMARY OF THE INVENTION

Accordingly, it is an objective of the present invention to overcome the above problems, and also to provide a piezoelectric actuator with a configuration enabling simplifying a production process while avoiding short circuits and warping.

In order to achieve the above and other objectives, there is provided an ink jet print head including a cavity plate and a piezoelectric actuator. The cavity plate is formed with a plurality of nozzles and a plurality of pressure chambers each corresponding to one of the plurality of nozzles. The piezoelectric actuator includes a plurality of first piezoelectric sheets extending in a first direction, a plurality of second piezoelectric sheets extending in the first direction, a plurality of individual electrodes each corresponding to one of the plurality of pressure chambers and formed on the surface of the first piezoelectric sheets, and a plurality of common electrodes common to the plurality of pressure chambers and formed on the surface of the second piezoelectric sheets. The first piezoelectric sheets and the second piezoelectric sheets are arranged one on the other in alternation in a second direction perpendicular to the first direction so as to form a laminated structure. One of the first and second piezoelectric sheets at an end of the laminated structure lies on the cavity plate. The piezoelectric actuator is formed with first through holes formed in each of the first and second piezoelectric sheets in the second direction, except the one of the first and second piezoelectric sheets lying on the cavity plate. Each of the plurality of individual electrodes is formed at a position corresponding to the first through holes on the first piezoelectric sheets. The first through holes is filled with conductive material, thereby electrically connecting corresponding ones of the plurality of individual electrodes.

There is also provided a piezoelectric actuator used in a recording head including a cavity plate formed with a plurality of nozzles aligned in a first direction, and a plurality of channels each corresponding to one of the plurality of nozzles. The piezoelectric actuator includes a plurality of first piezoelectric sheets having a surface, a plurality of second piezoelectric sheets having a surface, and a plurality of first electrode patterns. The plurality of first piezoelectric sheets and the plurality of second piezoelectric sheets are arranged one on the other in a thickness direction perpendicular to the first direction. Each of the first electrode patterns is formed on the surface of one of the plurality of first piezoelectric sheets, and formed with a gap having a width in a second direction perpendicular to both the first direction and the thickness direction. The gaps of ones of the first electrode patterns are positioned shifted in the second direction from the gaps of another ones of the first electrode patterns.

DETAILED DESCRIPTION OF PREFERRED EMBODIMENTS

Figure 1:
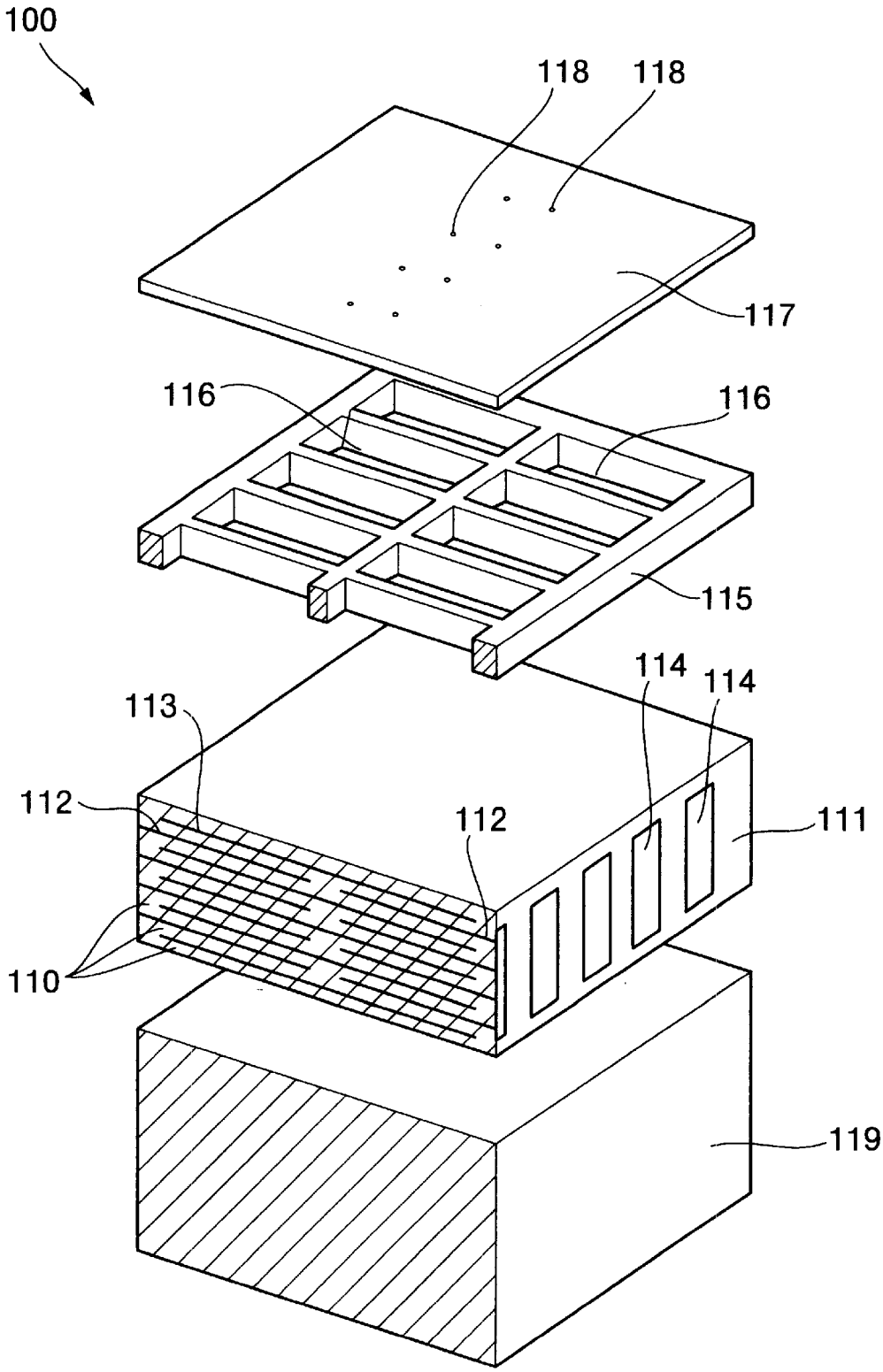
FIG. 1 is an exploded perspective view of a conventional piezoelectric ink jet printer head.
Figure 2:
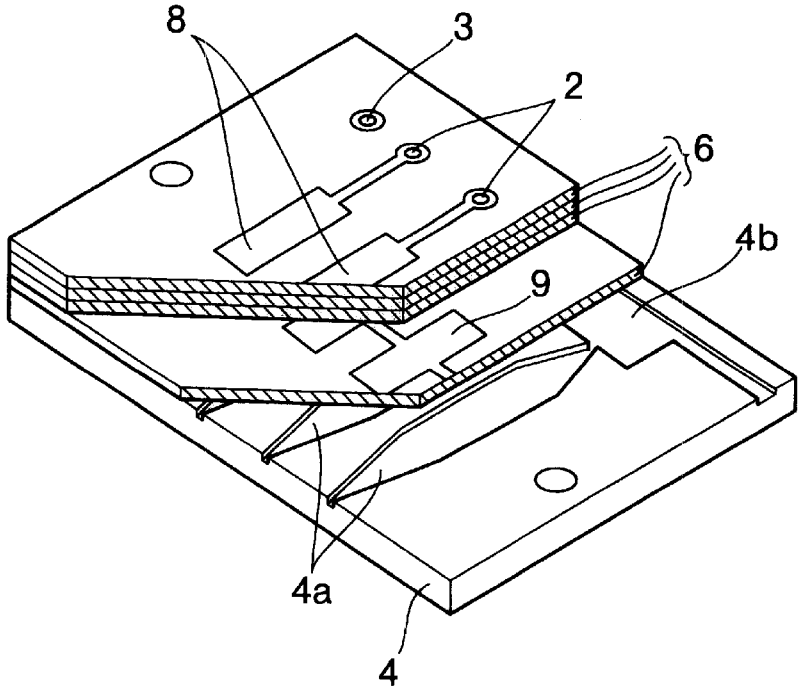
FIG. 2 is a perspective cutout view of a conventional piezoelectric actuator.
Figure 3:
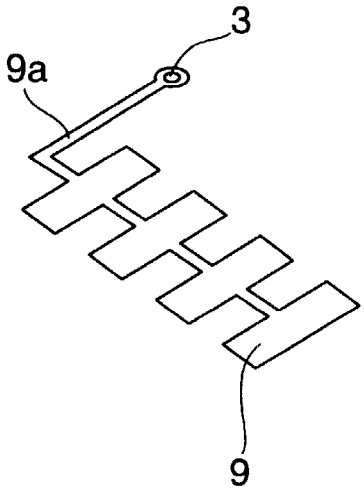
FIG. 3 is a plan view of a common electrode of the piezoelectric actuator of FIG. 2.
Figure 4:
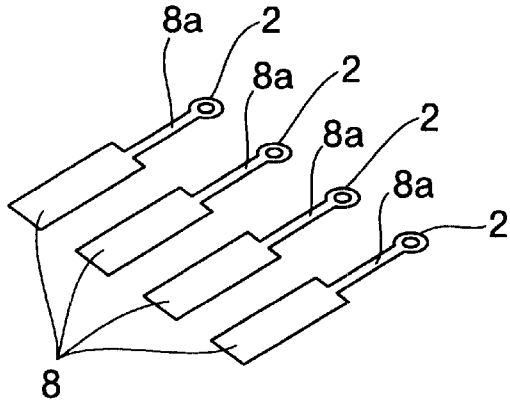
FIG. 4 is a plan view of individual electrodes of FIG. 2.
Figure 5:
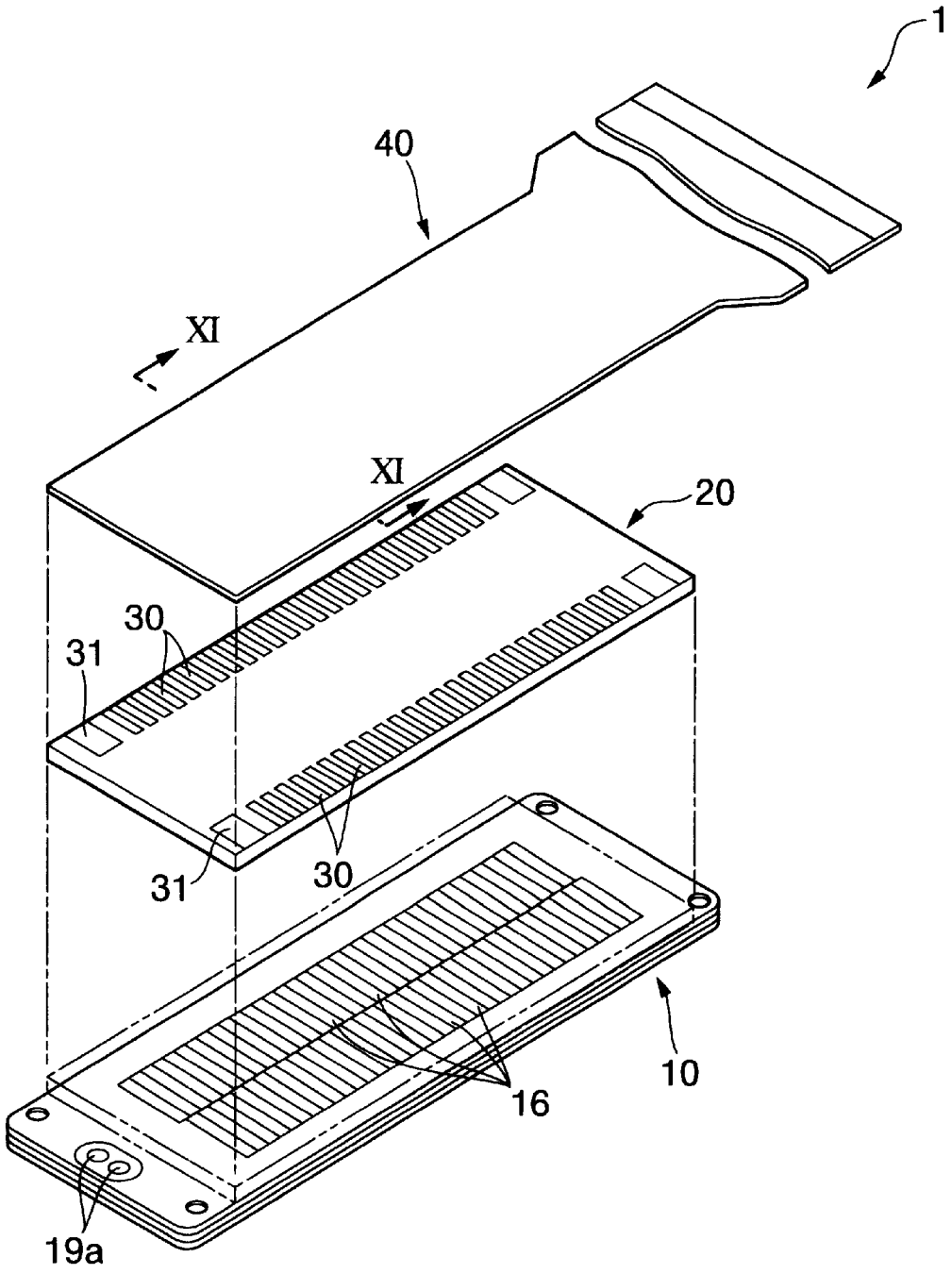
FIG. 5 is an exploded perspective view of a piezoelectric ink jet print head according to an embodiment of the present invention.
Figure 6:
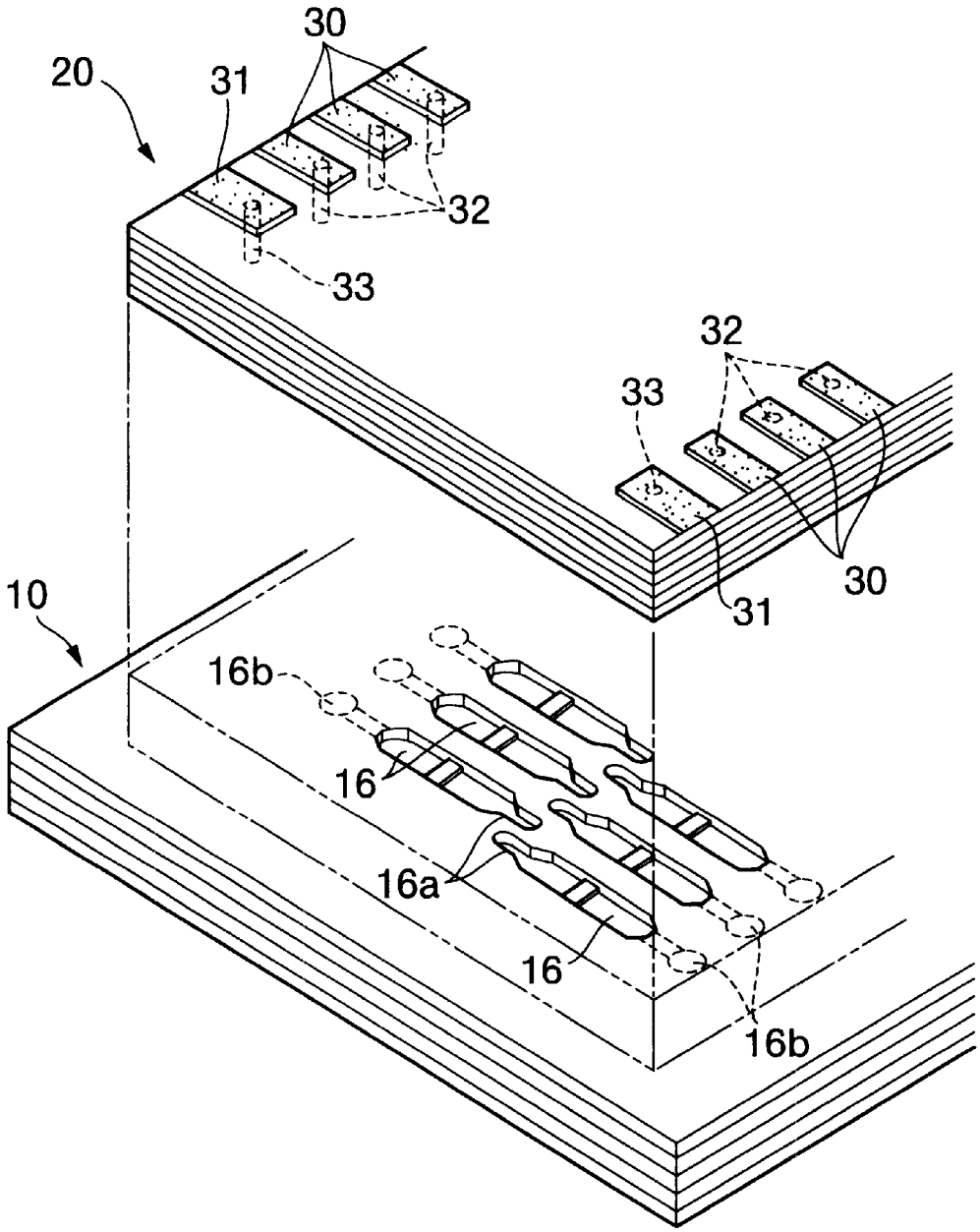
FIG. 6 is an exploded perspective partial view of FIG. 5.
Figure 11:
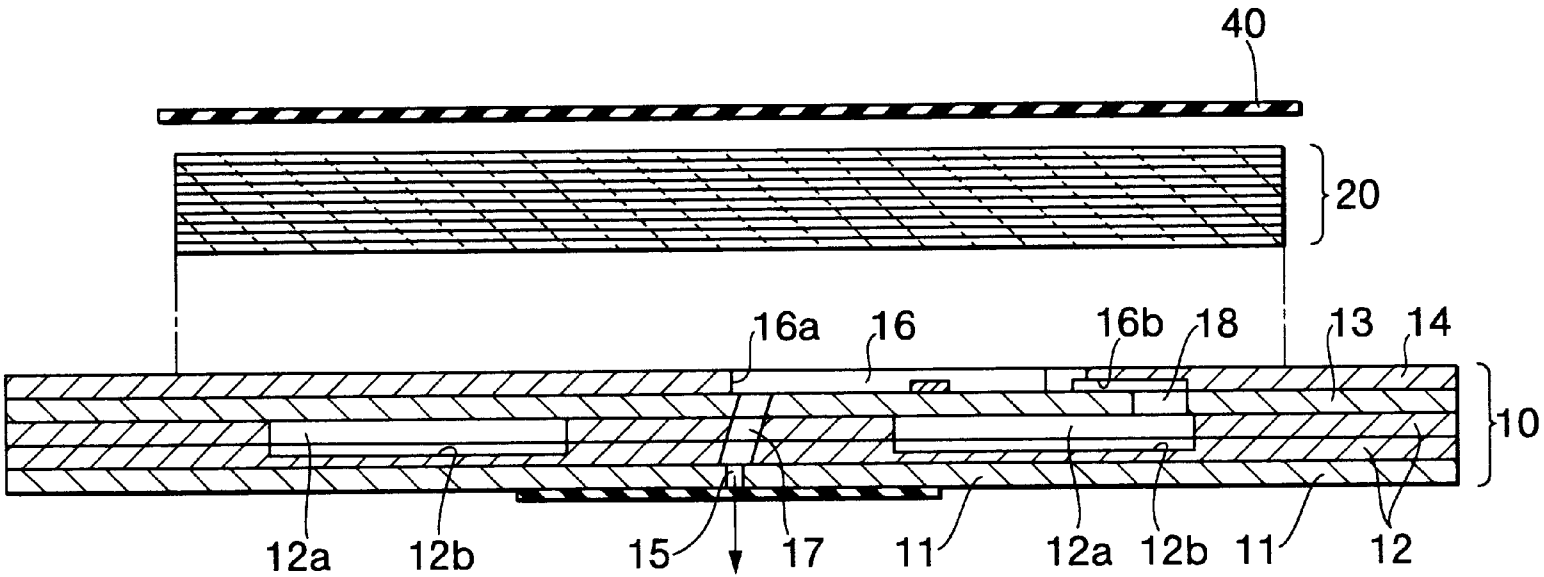
FIG. 11 is an explanatory cross-sectional view taken along a line XI—XI of FIG. 5.
Figure 12:
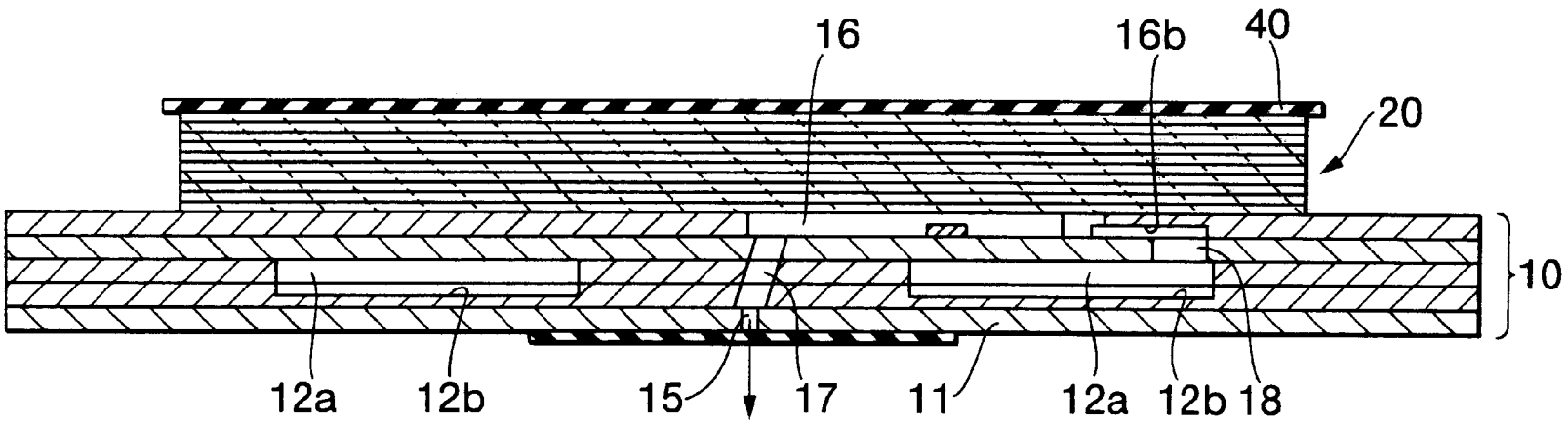
FIG. 12 is an explanatory cross-sectional view of the print head.

Next, a piezoelectric ink jet print head 1 according to an embodiment of the present invention will be described. As shown in FIGS. 5, 11, and 12, the piezoelectric ink jet print head 1 includes a cavity plate 10 made from a metal, a plate-shaped piezoelectric actuator 20, and a flexible cable 40 to be connected with an external device. The piezoelectric actuator 20 is laminated on the cavity plate 10. The flexible cable 40 is adhered onto the upper surface of the cavity plate 10 by an adhesive.

Figure 7:
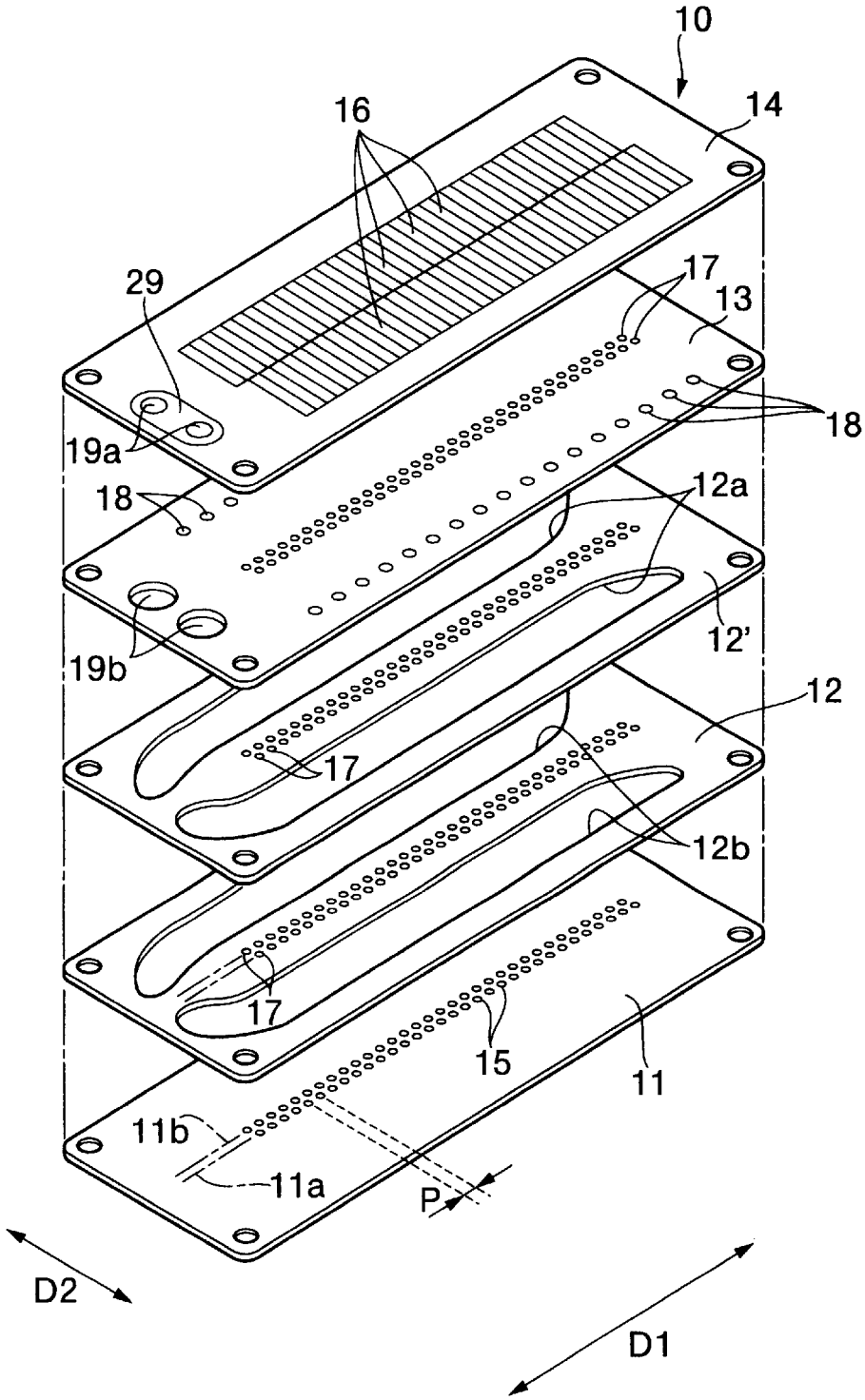
FIG. 7 is an exploded perspective view of a cavity plate of the print head of FIG. 5.
Figure 8:
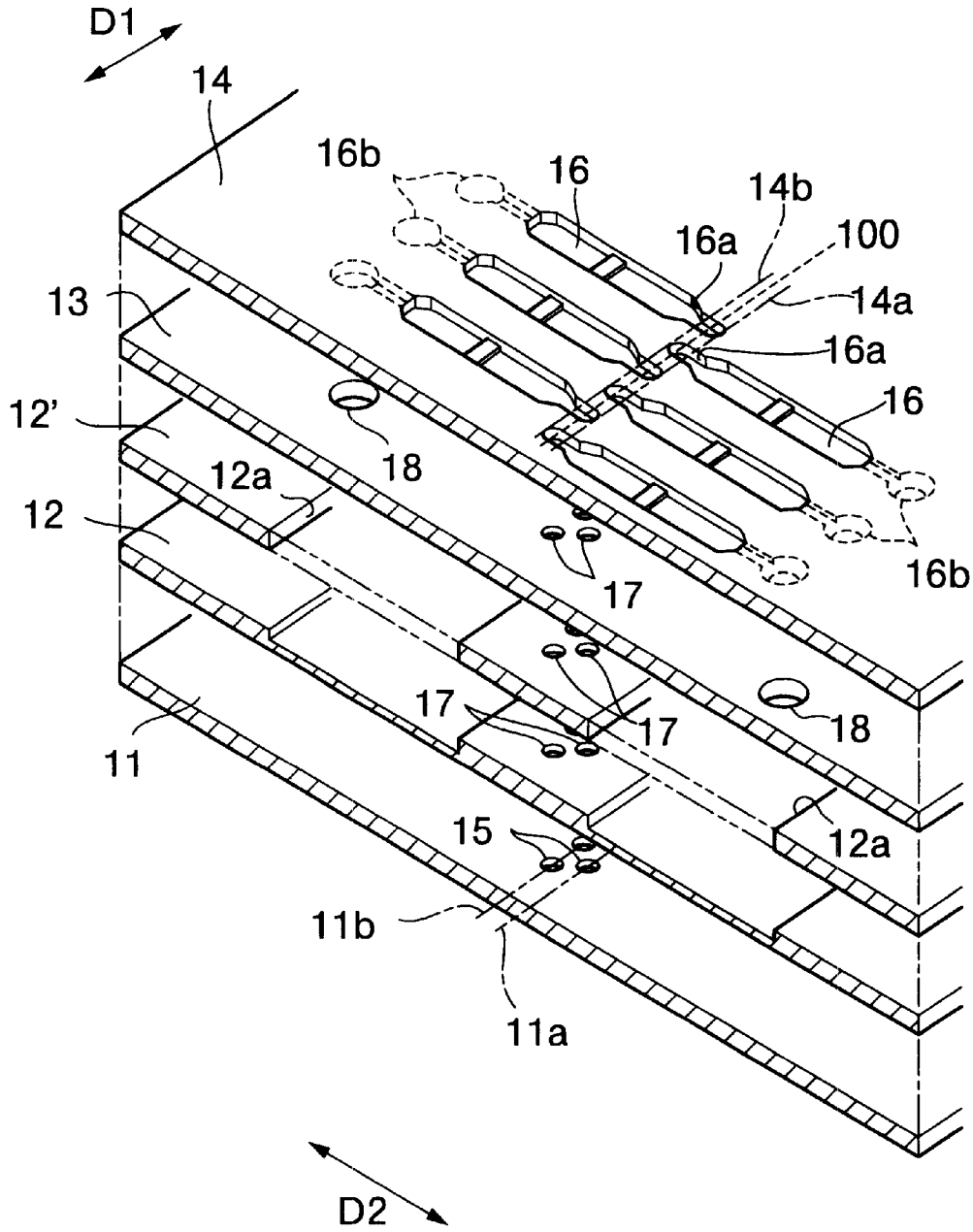
FIG. 8 is an exploded perspective partial view of the cavity plate.

As shown in FIGS. 7 and 8, the cavity plate 10 includes five thin metal plates laminated together. The thin plates include a nozzle plate 11, two manifold plates 12, 12', a spacer plate 13, and a base plate 14. The nozzle plate 11 is formed with small-diameter ink ejection nozzles 15. The nozzles 15 are formed in two rows that extend in a lengthwise direction D1 of the nozzle plate 11 in a staggered pattern. The nozzles 15 are opened separated from each other by small pitch P along two imaginary reference lines 11*a*, 11*b*.

The lower manifold plate 12, which confronts the nozzle plate 11, is formed with a pair of ink channels 12*b*, and the manifold plate 12' is formed with a pair of ink channels 12*a*. The ink channels 12*a*, 12*b* extend along the sides of the rows of nozzles 15 in the lengthwise direction D1. As shown in FIG. 8, the ink channels 12*a* in the upper manifold plate 12' are formed as through holes through the manifold plate 12'. On the other hand, the ink channels 12*b* in the lower manifold plate 12 are formed as indentations with the open side facing upward. Because the spacer plate 13 is laminated onto the upper manifold plate 12', the ink channels 12*a*, 12*b* are in a sealed condition.

The base plate 14 is formed with narrow-width pressure chambers 16 that extend in a widthwise direction D2, which is perpendicular to an imaginary central line 100 that follows the lengthwise direction D1. One half of the pressure chambers 16 are disposed substantially to the left of the imaginary central line 100 and the other half is disposed substantially to the right of the imaginary central line 100 in a staggered arrangement. Assuming that imaginary reference lines 14*a*, 14*b* extend parallel with the imaginary central line 100 and are disposed equidistance from the imaginary central line 100 on left and right sides thereof, respectively, tips 16*a* of pressure chambers 16 to the left of the imaginary central line 100 are aligned on the right-hand reference line 14*a* and the tips 16*a* of pressure chambers 16 to the right of the imaginary central line C are aligned on the left-hand reference line 14*b*.

Small through holes 17 are opened in the same staggered arrangement in the spacer plate 13 and the manifold plates 12, 12'. The through holes 17 bring the tips 16*a* of the pressure chambers 16 into fluid communication with the corresponding nozzles 15. Rows of through holes 18 are opened in both left and right sides of the spacer plate 13. The through holes 18 bring the other ends 16*b* of the pressure chambers 16 into fluid communication with the ink channels 12*a*, 12*b* of the manifold plates 12, 12'. It should be noted that as shown in FIG. 8, the other ends 16*b* are formed with an indented shape opened at the downward-facing-side of the base plate 14. Also, as shown in FIG. 7, supply holes 19*a* are opened in one end of the base plate 14, and supply holes 19*b* are opened in one end of the spacer plate 13. A filter 29 is stretched across the supply holes 19*a* from above for removing debris from an ink supplied from an ink tank (not shown), which is disposed above the base plate 14.

With this configuration, the ink supplied from the ink tank flows through the supply holes 19*a*, 19*b*, the ink channels 12*a*, 12*b*, the through holes 18, the pressure chambers 16, and the through holes 17 in this order, and then the ink reaches the nozzles 15 corresponding to the pressure chambers 16.

Figure 9:
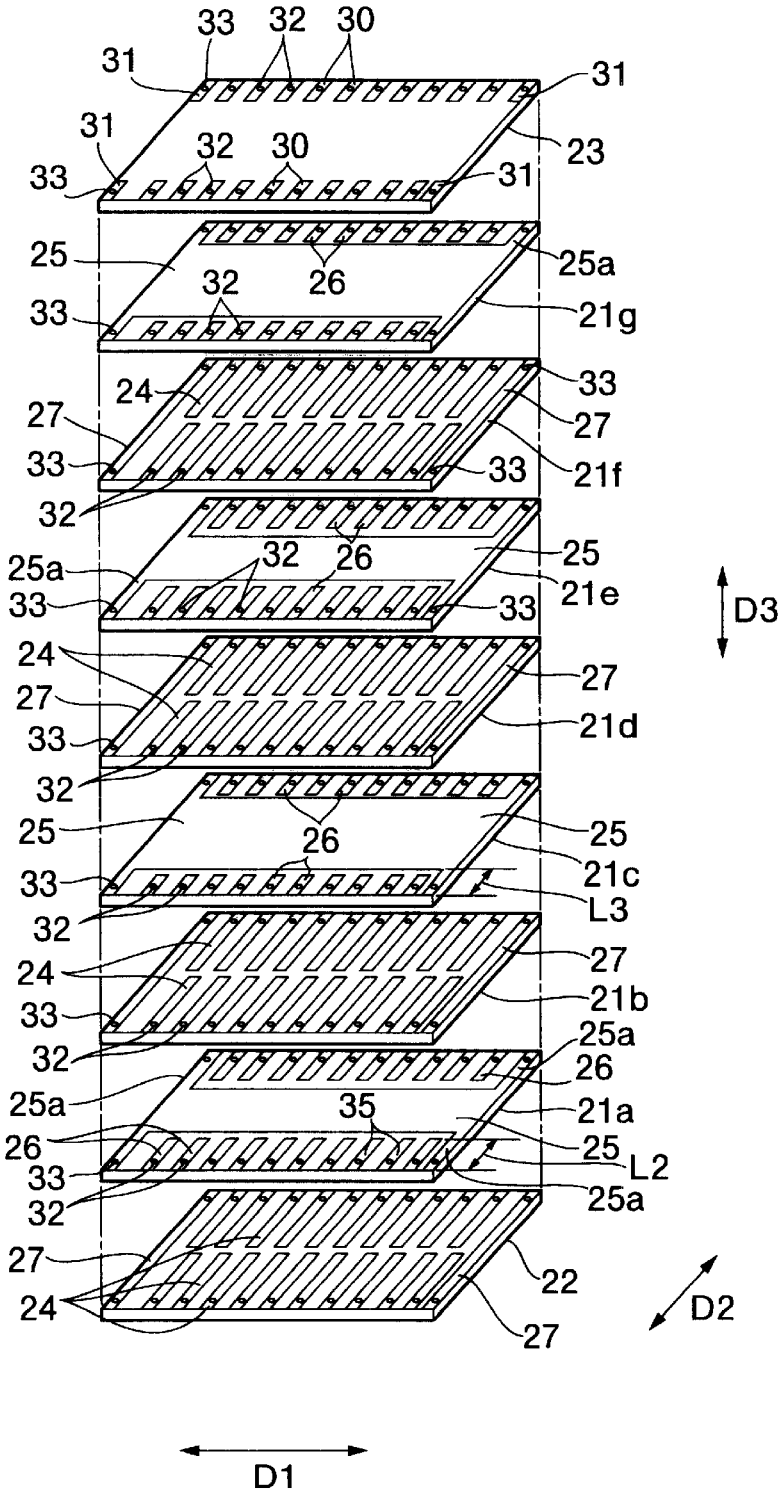
FIG. 9 is an exploded perspective view of a piezoelectric actuator of the print head of FIG. 5.
Figure 10:
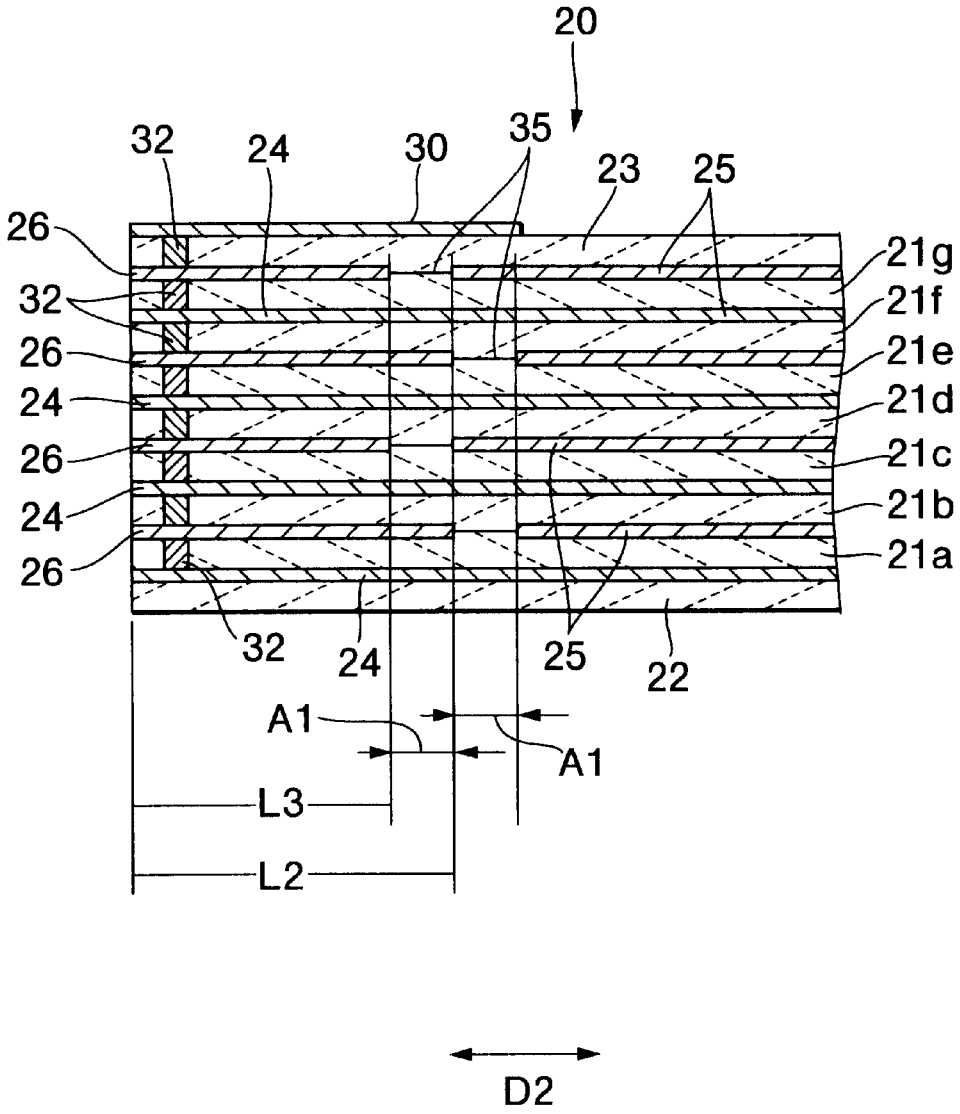
FIG. 10 is a cross-sectional view of the piezoelectric actuator.

As shown in FIGS. 9 and 10, the piezoelectric actuator 20 includes nine laminated piezoelectric sheets 22, 21*a*, 21*b*, 21*c*, 21*d*, 21*e*, 21*f*, 21*g*, and 23. Counting up from the lowermost piezoelectric sheet 22, odd-numbered piezoelectric sheets 22, 21*b*, 21*d*, and 21*f* are formed at their upper surface, which is the broadest surface, with a plurality of thin individual electrodes 24 for each of the pressure chambers 16 in the cavity plate 10. The individual electrodes 24 are aligned in rows extending in lengthwise direction D1. Each individual electrode 24 extends in the widthwise direction D2 to the corresponding lengthwise edge of the corresponding piezoelectric sheet.

The even-numbered piezoelectric sheets 21*a*, 21*c*, 21*e*, 21*g* are formed at their upper surface with common electrodes 25, which are shared commonly by all of the pressure chambers 16.

As can be understood by comparing FIGS. 8 and 9, the individual electrodes 24 are formed with a width sufficient to cover the wide-width portion of the pressure chambers 16, As described above, the pressure chambers 16 are arranged in two rows along the lengthwise direction D1, substantially through the widthwise center of the base plate 14. Therefore, in order to integrally cover the two rows of pressure chambers 16, 16, each common electrode 25 is formed in a substantially rectangular shape, as viewed in plan, extending in the lengthwise direction D1 through the substantial center in the widthwise direction D2. Also, leads 25*a*, 25*a* are formed integrally with the common electrodes 25 substantially across the entire widthwise ends of the even-numbered piezoelectric sheets 21*a*, 21*c*, 21*e*, 21*g*.

Individual dummy electrodes 26 are formed along lengthwise ends of the even-numbered piezoelectric sheets 21*a*, 21*c*, 21*e*, 21*g* at positions where the common electrodes 25 are not formed. The individual dummy electrodes 26 are formed at positions that correspond in a vertical sense to the individual electrodes 24 and have the same width in the lengthwise direction D1 as the individual electrodes 24.

As shown in FIGS. 9 and 10, the inward-facing tip of each individual dummy electrode 26 is separated from the common electrode 25 in the widthwise direction D2 by a space 35 of suitable width A1. Also, the individual dummy electrodes 26 are formed to different lengths L2 and L3, wherein L3<L2, in alternation. With this configuration, the position of the space 35 between the inward facing end of each individual dummy electrode 26 and the side edge of the common electrodes 25 is shifted in the widthwise direction D2 for every other piezoelectric sheet in the laminated stack.

More specifically, as shown in FIG. 10, the dummy electrodes 26 on the piezoelectric sheets 21*a* and 21*e* are formed to the length L2. The individual dummy electrodes 26 on the piezoelectric sheets 21*c* and 21*g* are formed to the length L3. The length L2 is longer than the length L3 by a distance A1.

With this configuration, overall width of the spaces 35 in the widthwise direction D2 is as large as twice the distance A1 (2×A1). Also, the density of the electrodes 24, 26 in a thickness, direction D3 is not clustered with respect to the second direction D2.

Figure 13:
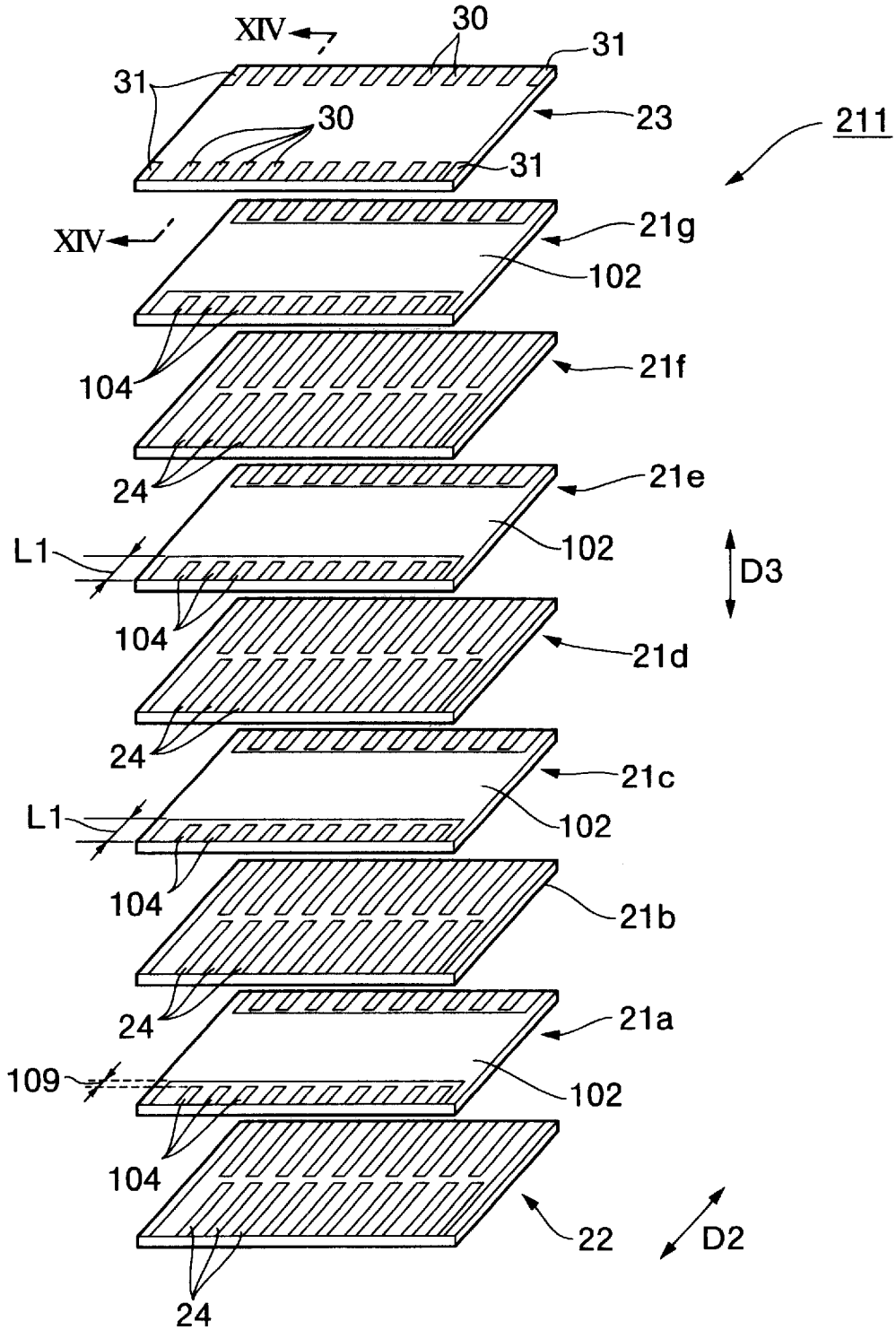
FIG. 13 is an exploded perspective view of a conceivable piezoelectric actuator.
Figure 14:
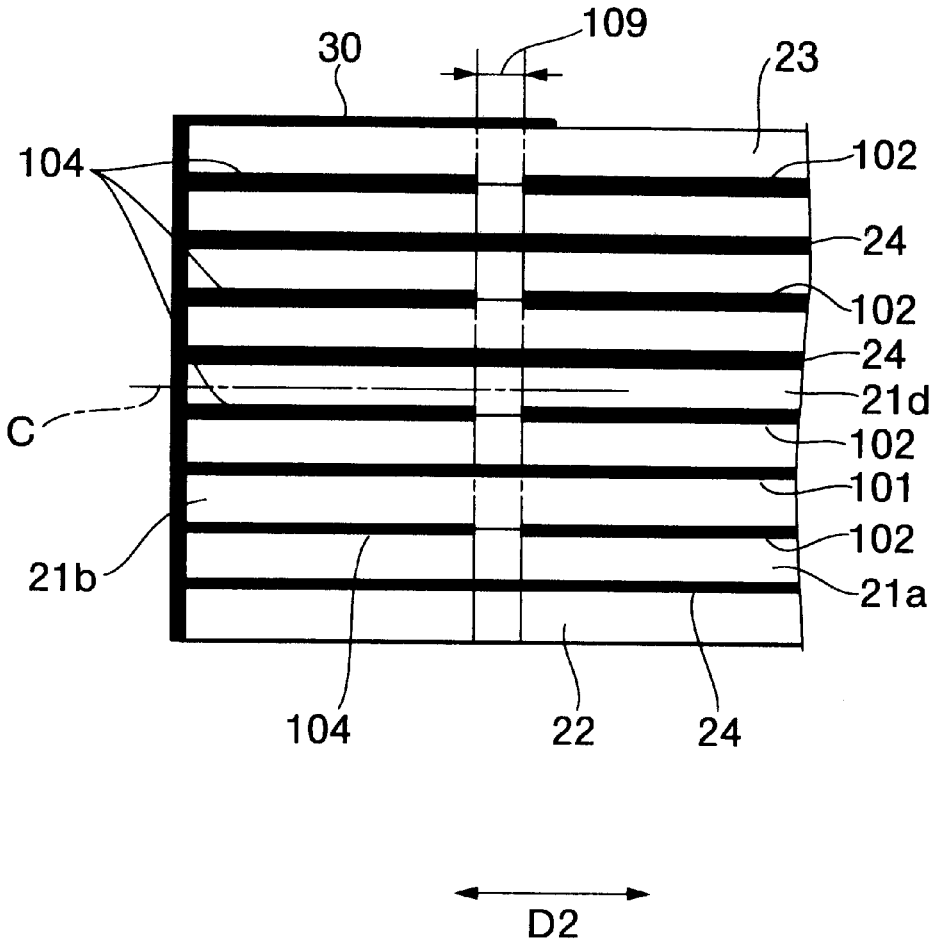
FIG. 14 is a cross-sectional view taken along a line XIV—XIV of FIG. 13.

It should be noted that it is conceivable to form the piezoelectric actuator in a configuration as shown in FIGS. 13 and 14, where all dummy electrodes 104 are formed to the same length L1 in the widthwise direction D2 and the inward-facing tip of each dummy electrode 104 is separated from a corresponding common electrode 102 in the widthwise direction D2 by a space 109. However, this configuration has a following problem.

That is, usually electrodes are formed to piezoelectric sheets by conductive paste, and then the piezoelectric sheets are stacked one on the other, pressed, and sintered. At this time, each of the piezoelectric sheets shrinks in its thickness direction. However, the amount of the shrinkage is not uniform. Portion of the piezoelectric sheets formed with the electrodes shrinks more than that formed with no electrodes.

A center line C shown in FIG. 14 indicates a center of the piezoelectric actuator in the thickness direction D3. Within the space 109, the distributions of the electrodes are uneven between the upper side and the lower side of the center line C. Specifically, as will be understood from FIG. 14, the electrodes at the upper side clusters toward the center line C, and the electrodes at the lower side clusters away from the center line C. Accordingly, shrinkage of the piezoelectric electrodes at the lower side of the center line C during the manufacturing process makes the overall actuator sharply warp into a reversed V-shape with the portion of the space 109 to the top.

When, such a warp is large or sharp, a cavity plate will not be properly adhered to the actuator, and there will be an undesirable space formed between the cavity plate and the actuator, resulting in ink leak.

However, according to the configuration of the present embodiment, when considering the piezoelectric actuator 20 overall, the spaces 35 will be less clustered with respect to the widthwise direction D2, and the electrodes are less dense in the thickness direction D3 at the locations of the space 109. Therefore, the piezoelectric actuator 20 will warp to a lesser extent in the thickness direction D3 when sintered in subsequent processes. Furthermore, because the sintered piezoelectric actuator 20 will have a smooth arched shape, the piezoelectric actuator 20 and the cavity plate 10 will be in intimate contact with no gaps therebetween when the piezoelectric actuator 20 is adhered and fixed to the cavity plate 10. The resulting product will not have any leaks. Also, less adhesive pressure is required to press the piezoelectric actuator 20 and the cavity plate 10 flat together.

Common dummy electrodes 27 are formed on the upper surfaces of the odd-numbered piezoelectric sheets 22, 21*b*, 21*d*, and 21*f* along the widthwise ends at positions that correspond vertically to the leads 25*a*, 25*a*.

Upper-surface electrodes 30, 31 are formed along the lengthwise edge on the upper surface of the top sheet 23. The upper-surface electrodes 30 are at positions corresponding to the individual electrodes 24. The upper-surface electrodes 31 are at the four corners of the top sheet 23 for the common electrodes 25.

Further, through holes 32 and 33 are opened in the top sheet 23 and all of the piezoelectric sheets 21*a* to 21*g*, but not in the lower-most piezoelectric sheet 22. The through holes 32 are formed at positions corresponding to the surface electrodes 30, the individual electrodes 24, and the individual dummy electrodes 26. The through holes 33 are formed at positions corresponding to the surface electrodes 31, the leads 25*a*, of the common electrodes 25, and the common dummy electrodes 27. The through holes 32, 33 are filled with conductive material to electrically connect together the upper-surface electrodes 30 and corresponding individual electrodes 24 of the different layers and, similarly, to electrically connect together the upper-surface electrodes 31 and the corresponding common electrodes 25 of different layers.

Next, a method for producing the piezoelectric actuator 20 will be described. First, a plurality of ceramic green sheets are prepared for the piezoelectric sheets 22, 21*a*–21*g*, and the top sheet 23. Then, the through holes 32 are opened in each of the piezoelectric sheets 21*a*–h 21*g* at positions corresponding to the individual electrodes 24 and the common dummy electrodes 27. In the same manner, the through holes 33 are opened in each of the piezoelectric sheets 21*a*–21*g* at positions corresponding to the common electrodes 25 and the individual dummy electrodes 26. Further, the through holes 32, 33 are opened in the top sheet 23 at positions corresponding to the surface electrodes 30, 31.

Next, the individual electrodes 24 and the common dummy electrodes 27 are formed on the surface of each piezoelectric sheet 22, 21*b*, 21*d*, 21*f* using screen printing with a conductive paste. The common electrode 25 and the individual dummy electrodes 26 are formed on the surface of each piezoelectric sheet 21*a*, 21*c*, 21*e*, 21*g* using screen printing with a conductive paste. Also, the surface electrodes 30, 31 are formed on the surface of the top sheet 23 using screen printing with a conductive paste. At this time, because the through holes 32, 33 are provided in the piezoelectric sheets 21*a*–21*g* and the top sheet 23, the conductive paste enters into the through holes 32, 33 and brings the corresponding electrodes into electrical connection with each other at the upper surface and the lower surface of each of the sheets 21*a*–21*g*, 23 when laminated one on the other.

After drying out, the piezoelectric sheets 22, 21*a*–21*g* and the top sheet 23 are stacked together in a manner shown in FIG. 9 and pressed into an integral laminated unit. Then, the resultant integral laminated unit is subjected to sintering.

As a result, the surface electrodes 30 formed on the top sheet 23 are electrically connected via the conductive paste in the through holes 32 to the individual electrodes 24 and the individual dummy electrodes 26 in correspondence in the vertical sense. Also, the surface electrodes 31 are electrically connected via the conductive paste in the through holes 33 to the common electrodes 25 and the common dummy electrodes 27 in correspondence in the vertical sense.

The piezoelectric actuator 20 produced in this manner is fixed in place to the cavity plate 10 in a manner shown in FIGS. 5 and 11 such that each individual electrode 24 is aligned with the corresponding pressure chamber 16. Then, the flexible cable 40 is stacked and pressed on the upper surface of the piezoelectric actuator 20. As a result, each type of wiring pattern (not shown) in the flexible cable 40 is electrically connected to the upper surface electrodes 30, 31.

In this arrangement, when a voltage is applied between the common electrodes 25 and selected ones of the individual electrodes 24, portions of the piezoelectric sheets 21, 22 corresponding to the individual electrodes 24 applied with the voltage deform in the thickness direction D3. As a result, the volume in the corresponding pressure chambers 16 drops, thereby ejecting an ink droplet from the corresponding nozzles 15, so that printing is performed as shown in FIG. 12.

As described above, according to the embodiment of the present invention, the electrical connection among the individual electrodes 24 and the surface electrodes 30 and among the common electrodes 25 and the surface electrodes 31 are achieved in the thickness direction D3 through the through holes 32, 33 formed in the piezoelectric sheets 21*a*–21*g* and the top sheet 23. Therefore, there is no danger that the electrical connection is damaged by accidental contact of a handler or a tool during production or assembly of the piezoelectric actuator 20.

Moreover, because the through holes 32, 33 are not formed in the piezoelectric sheet 22 that directly contacts the cavity plate 10, the individual electrodes 24 and the common electrodes 25 are in complete electric isolation from the cavity plate 10, even if the cavity plate 10 is formed from a conductive material, such as 42% nickel-alloy steel. Also, because the through holes 32, 33 are not formed in the piezoelectric sheet 22, the water-based ink in the pressure chambers 16 will not produce electrically short circuits even if the individual electrodes 24 or the common electrodes 25 are positioned with vertical overlap with any of the pressure chambers 16.

As a result, the through holes 32, 33 can be formed anywhere in the piezoelectric actuator 20, with no restriction to position, so that the piezoelectric actuator 20 can be designed with great freedom.

According to the embodiment of the present invention, the individual electrodes 24 and the common electrodes 25 are formed in alternation on the piezoelectric sheets 22, 21. Also, the individual dummy electrodes 26 are formed vertically between the individual electrodes 24, and the common dummy electrodes 27 are formed vertically between the common electrodes 25. Also, the through holes 32 formed in the sheets 21, 23 and filled with the conductive paste reliably and electrically connect the individual dummy electrodes 26 to the vertically aligned corresponding individual electrodes 24, and the through holes 33 formed in the sheets 21, 23 and filled with the conductive paste reliably and electrically connect the common electrodes 25 to the vertically aligned corresponding common dummy electrodes 27.

Also, the dummy electrodes 26, 27 reduce the amount of deviation in thickness of the laminated piezoelectric sheets. If there are no individual dummy electrodes 26 or common dummy electrodes 27, the laminated piezoelectric sheets will have uneven thickness.

It should be noted that the conductive material that is coated on the piezoelectric sheets to form the electrodes 24, 25, 30, 31 will enter into and fill the through holes 32, 33 when each piezoelectric sheet is 30 microns thick and when the each electrode 20, 25, 30, 31 are formed to about 5 microns thick. However, when the each piezoelectric sheet is fairly thick, the conductive material can be reliably drawn into the through holes 32, 33 by applying suction to the reverse side of the piezoelectric sheet from where the conductive material was coated.

While some exemplary embodiments of this invention have been described in detail, those skilled in the art will recognize that there are many possible modifications and variations which may be made in these exemplary embodiments while yet retaining many of the novel features and advantages of the invention.

For example, the surface electrodes 30, 31 can be formed with a metal layer thereon by energizing a narrow-width electrode pattern on the surface electrodes 30, 31 to perform electrolysis while the laminated body of the piezoelectric sheets are immersed in a plating solution. An example of the metal layer is a gold layer on top of a nickel layer serving as a based layer. Such a metal layer improves electrical connection between the wiring patterns in the flexible flat cable 40 with the corresponding surface electrode 30, 31.

Needless to say, the order in which the layers of the individual electrodes 24 and of the common electrodes 25 are laminated can be changed as appropriate in order to bring the lower-most piezoelectric sheet with the common electrode 25 into confrontation with the base sheet 14 in the cavity sheet 10. Also, instead of the through holes 32, 33, side electrodes can be formed on the side surfaces of the laminated body of the piezoelectric actuator for the electrical connection among the electrodes 24, 25, 26, 27. In this case, indented grooves can be formed to the side surfaces of the laminated body for exposing the electrodes 24, 25, 26, 27 and the side electrodes can be formed in the indented grooves.

Further, the present invention can be applied when the direction D1 is the direction along the short dimension of the piezoelectric actuator 20 and the direction D2 is the direction along the long dimension of the piezoelectric actuator 20.

Also, there is no need to form all four through holes 33 as long as there is at least one through hole 33 opened to connect at least one surface electrode 31 with the corresponding leads 25*a* or the common electrodes 25. In this case, at least one surface electrode 31 can be formed, rather than all four of the surface electrodes 31.

Moreover, although in the above-described embodiment the piezoelectric sheet 22 is used as a bottom sheet of the piezoelectric actuator 20, the sheet 22 can be formed of different insulation material as long as the sheet 22 can reliably transmits the deformation of the piezoelectric sheets 21*a* through 21*g*. Also, the top sheet 23 can be formed of insulation material other than the piezoelectric material. In this case, it is preferable that the top sheet 23 be able to suppress the upward warping of the piezoelectric actuator 20.

Further, when the common electrodes 25 are connected to the ground, the through holes 33 can be electrically connected to the cavity plate 10.

What is claimed is:

1. An ink jet print head comprising:

a cavity plate formed with a plurality of nozzles and a plurality of pressure chambers each corresponding to one of the plurality of nozzles; and a piezoelectric actuator including:

a plurality of first piezoelectric sheets extending in the first direction;

a plurality of second piezoelectric sheets extending in the first direction, wherein the first piezoelectric sheets and the second piezoelectric sheets are arranged one on the other in alternation in a second direction perpendicular to the first direction so as to form a laminated structure, one of the first and second piezoelectric sheets at an end of the laminated structure lying on the cavity plate, and first through holes are formed in each of the plurality of first and second piezoelectric sheets in the second direction, except the one of the first and second piezoelectric sheets lying on the cavity plate; and the piezoelectric actuator is formed with a plurality of individual electrodes each corresponding to one of the plurality of pressure chambers and formed on the surface of the first piezoelectric sheets at positions corresponding to the first through holes, and a plurality of common electrodes common to the plurality of pressure chambers and formed on the surface of the second piezoelectric sheets, the first through holes being filled with conductive material, thereby electrically connecting corresponding ones of the plurality of individual electrodes in the second direction.

2. The ink jet print head according to claim 1, wherein at least one second through hole is formed in each of the plurality of first and second piezoelectric sheets in the second direction except the one of the first and second piezoelectric sheets lying on the cavity plate, the at least one second through hole being filled with conductive material, thereby electrically connecting the plurality of common electrodes.

3. The ink jet print head according to claim 2, wherein the piezoelectric actuator further comprises:

a third sheet extending in the first direction and lying on another end of the laminated structure such that the third sheet and the cavity plate sandwich the laminated structure therebetween, the third sheet having third through holes and at least one fourth through hole that penetrate through the third sheet;

a plurality of first surface electrodes formed on the surface of the third sheet each corresponding to one of the pressure chambers; and at least one second surface electrode formed on the surface of the third sheet, wherein the first surface electrodes are positioned over the third through holes and the at least one second surface electrode is positioned over the at least one fourth through hole, the third through holes being filled with the conductive material, thereby electrically connecting each of the first surface electrodes and the corresponding ones of the plurality of individual electrodes in the second direction, and the at least one fourth through hole being filled with the conductive material, thereby electrically connecting the at least one second surface electrode and the plurality of common electrodes.

4. The ink jet print head according to claim 2, wherein the piezoelectric actuator further comprises:

a plurality of individual dummy electrodes formed on each of the plurality of second piezoelectric sheets each dummy electrode aligned in the second direction with one of the plurality of individual electrode on each of the plurality of first piezoelectric sheets; and a common dummy electrode on each of the first piezoelectric sheets aligned in the second direction with the common electrode on each of the plurality of second piezoelectric sheets, wherein the first through holes further electrically connect corresponding ones of the individual dummy electrodes with the corresponding ones of the individual electrodes, and the at least one second through hole further electrically connects the common dummy electrodes.

5. A piezoelectric actuator used in a recording head including a cavity plate formed with a plurality of nozzles aligned in a first direction, and a plurality of channels each corresponding to one of the plurality of nozzles, the piezoelectric actuator comprising:

a plurality of first piezoelectric sheets having a surface;

a plurality of second piezoelectric sheets having a surface, wherein the plurality of first piezoelectric sheets and the plurality of second piezoelectric sheets are arranged one on the other in alternation in a thickness direction perpendicular to the first direction; and a plurality of first electrode patterns each formed on the surface of one of the plurality of first piezoelectric sheets, and each formed with a gap having a width in a second direction perpendicular to both the first direction and the thickness direction, wherein gaps of ones of the first electrode patterns are positioned shifted in the second direction from the gaps of another ones of the first electrode patterns, and the gaps extend in the first direction.

6. The piezoelectric actuator according to claim 5, further comprising a plurality of second electrode patterns each formed on the surface of one of the second piezoelectric sheets, wherein each of the second electrode patterns includes a plurality of individual electrodes each corresponding to one of the plurality of pressure chambers, and each of the first electrode pattern includes a plurality of individual dummy electrodes each corresponding to one of the plurality of pressure chambers.

7. The piezoelectric actuator according to claim 6, wherein the surface of each of the first and second piezoelectric sheets has a side edge extending in the first direction, and the plurality of individual electrodes of each second electrode pattern are aligned along the side edge of the surface of the corresponding second piezoelectric sheet, and the plurality of individual dummy electrodes of each first electrode pattern are aligned along the side edge of the surface of the corresponding first piezoelectric sheet.

8. The piezoelectric actuator according to claim 6, wherein each of the first electrode pattern further includes a common electrode formed at a center of corresponding one of the first piezoelectric sheets with respect to the second direction and extending in the first direction.

9. The piezoelectric actuator according to claim 8, wherein the gap of the first electrode pattern is defined between the common electrode and the plurality of individual dummy electrodes.

10. The piezoelectric actuator according to claim 5, wherein a through hole is opened to each of the first and second piezoelectric sheets in the thickness direction except one of the first and second piezoelectric sheets.

11. The piezoelectric actuator according to claim 10 wherein the through hole is filled with a conductive material, and the one of the first and the second piezoelectric sheets is brought into intimate contact with the cavity plate.

12. The piezoelectric actuator according to claim 5, wherein the plurality of first electrode patterns includes a first set of patterns and a second sets of patterns, the first set of pattern including a plurality of first individual dummy electrodes having a first length in the second direction, the second sets of pattern includes a plurality of second individual dummy electrodes having a second length greater than the first length in the second direction.

* * * * *